US005508603A

United States Patent [19]

Strong, III

[11] Patent Number: 5,508,603

[45] Date of Patent: Apr. 16, 1996

[54] POLARITY CORRECTED, INTERMITTENT COMPENSATED, REMOTE LOAD VOLTAGE REGULATION

[75] Inventor: Maurice L. Strong, III, Wheeling, Ill.

[73] Assignee: Northrop Grumman Corporation, Los Angeles, Calif.

[21] Appl. No.: 412,402

[22] Filed: Mar. 28, 1995

[51] Int. Cl.[6] ..... G05F 1/10

[52] U.S. Cl. ..... 323/234; 323/909; 340/652

[58] Field of Search ..... 323/234, 909; 340/652; 361/91

[56] References Cited

U.S. PATENT DOCUMENTS 4,237,517 12/1980 Myers ..... 361/239

4,535,203 8/1985 Jenkins et al. ..... 179/81 R 4,890,002 12/1989 Schornack ..... 307/66

5,117,174 5/1992 Kessler ..... 322/21

*Primary Examiner*—Peter S. Wong

*Assistant Examiner*—Adolf Berhane

*Attorney, Agent, or Firm*—Terry J. Anderson; Karl J. Hoch, Jr.

[57] ABSTRACT

A remote load (14) is powered by a power supply 12 in response to a PWM IC (9), the error amp (10) of which is responsive to a voltage feedback signal on remote sense leads (19, 20) from the load. Remote sense leads (19, 20) are applied through a polarity correcting bridge (23) to the input (11) of the error amp (10). To compensate for broken leads, when the output of the bridge (28) falls below a threshold voltage (32), a switch (34) operates to connect the input of the error amp to the output (16, 37) of the power supply, locally.

6 Claims, 1 Drawing Sheet

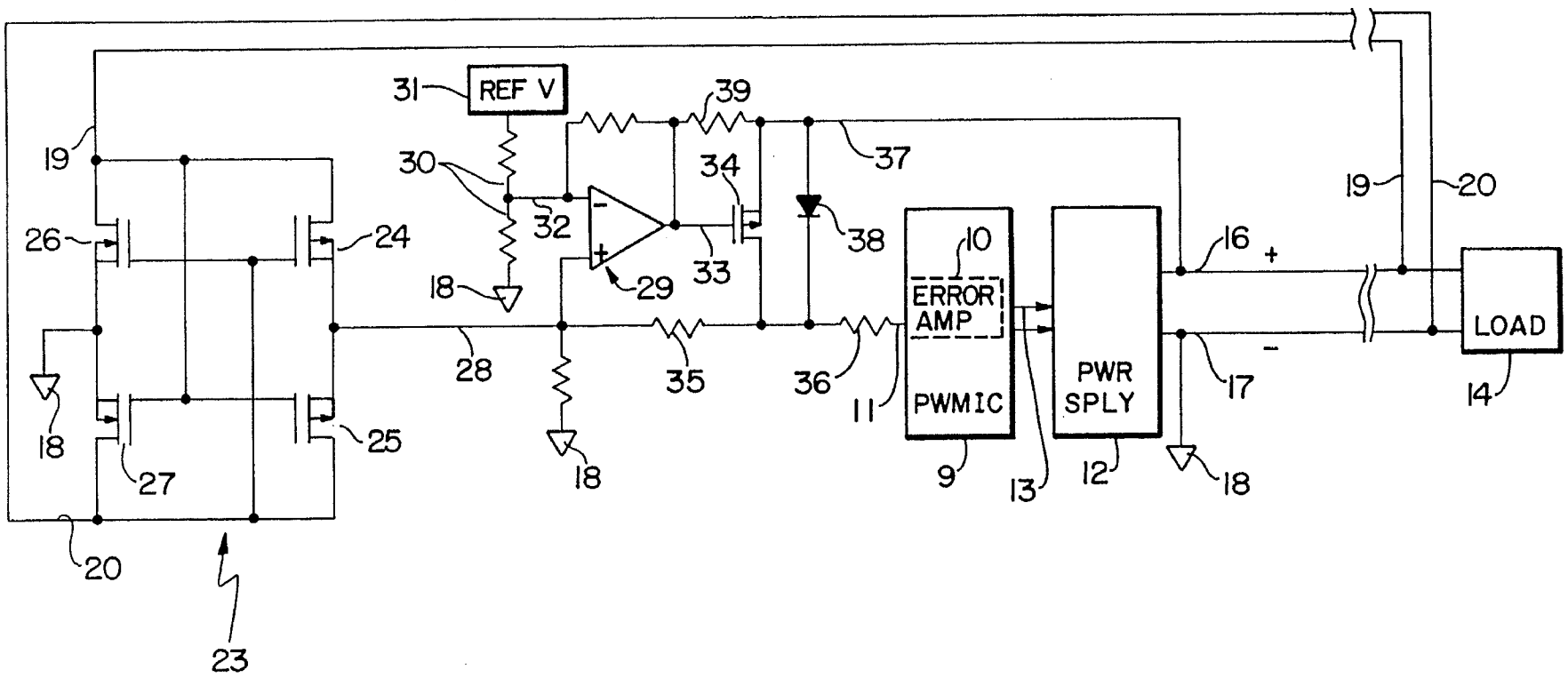
LOAD
14
20
19
16
+
-
17
18
PWR SPLY
12
13
10
ERROR AMP
PWMIC
9
11
37
38
36
39
34
33
35
29
32
REF V
31
30
28
24
25
23
27
26

POLARITY CORRECTED, INTERMITTENT COMPENSATED, REMOTE LOAD VOLTAGE REGULATION

TECHNICAL FIELD

This invention relates to locally regulating the voltage of a remote load without regard to the polarity of the remote load voltage sensing circuits, and with regulation compensated locally for loss of remote signal, including intermittent loss of remotely sensed signal.

BACKGROUND ART

Voltage drop along the main power supply and return wires of loads located remotely from a power source interferes with regulating the desired voltage. It is well known that the output voltage of a power source which is feeding a high current load located remotely from the power source may be regulated utilizing feedback signals indicative of the voltage at the load, provided to the power source regulator by means of remote sense leads, rather than using the voltage at the immediate output of the power source. In U.S. Pat. No. 3,818,274, the voltage at the remote load is utilized as a feedback for comparison with a commanded voltage from a computer; the same remote load voltage is utilized to clamp the power amplifier so that it cannot give an excessive overvoltage or undervoltage, regardless of how the computer attempts to drive the output power. However, if the sense lead is broken, the output power will be driven further in whichever polarity the source is attempting to regulate, the overvoltage cannot be detected since the sense lead is broken, and thus the clamp circuit will do no good. In U.S. Pat. No. 4,551,668, detectors are provided to determine if either the sense lead or the sense return lead are broken, and operate an alarm in such case. However, the alarm does not alter the circuit operation, and therefore intermittent breaks will simply cause the alarm to cycle on and off. Furthermore, the connection of the remote sense and sense return lines at the voltage regulation circuit is polarity sensitive, and reversing the polarity of the sense and sense return lines at the input to the voltage regulator will cause the voltage regulator to attempt to drive the load into an overvoltage condition, thereby damaging the power source or the load, or both. In addition, the detector itself is polarity sensitive in the aforesaid '668 patent. Thus, if the sense and sense return lines are reversed when connected, the broken lead detectors will not work.

U.S. Pat. No. 5,117,174 discloses a variable speed, constant frequency aircraft generator system which has a remote voltage regulator sensing voltage at the remote loads for controlling the engine driven power source. It utilizes the power source output voltage at the power source to regulate the voltage of the power source, and utilizes a remote voltage regulator to provide signals from which a trim bias is generated to bias the local voltage regulator in a manner to overcome any losses in the lines feeding the loads. However, this system is useless except where the remote voltage regulator is already in place, and furthermore, it will provide no trim signal in the event that either of the sense leads are broken.

DISCLOSURE OF INVENTION

Objects of the present invention include obviating the difficulty associated with the necessity to assure correct polarity of connection of remote load voltage sensing leads, and providing adequate backup operation in the event of breakage of remote load voltage sensing leads in a power source providing high current to a remote load, the output voltage of which is regulated by means of the supplied voltage sensed at the load.

According to the present invention, if the value of a voltage feedback signal from a remote load deviates from a local reference sufficiently to indicate breakage of the feedback leads, the power source control switches its response from the voltage at the remote load to the voltage at the output of the source. In accordance further with the present invention, remote load sensing leads in a controlled power source are connected to a polarity correcting bridge, the output of which is utilized to control the power source, thereby obviating the need to have the feedback leads connected in correct polarity.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole figure herein is a schematic block diagram of the invention.

BEST MODE FOR CARRYING OUT THE INVENTION

Referring now to the drawing, a typical DC power system includes a pulse width modulation integrated circuit (PWM IC) 9 which includes an error amplifier (amp) 10 responsive to a feedback signal on a line 11 indicative of a feedback voltage used to control the power supply inverter output section 12, which responds to switching signals on lines 13 from the PWM IC 9. The switching signals on lines 13 determine the fraction of each half cycle that power is conducted into a filter which in turn provides the DC output of the power supply to a load 14 on lines 16 and 17. In the example herein, the line 16 is positive, and the line 17 is negative and is referenced to ground 18. The leads 16, 17 are connected at the distal end to the load 14. To provide feedback voltage to the input 11 of the error amplifier 10, a positive remote sense lead 19 is connected near the load to the power lead 16, and a negative remote sense lead 20 is connected near the load to the power lead 17.

It is known in the prior art to connect the supply output, such as the lead 16, to the feedback voltage input 11 of the error amp 10 for local control of the power supply. It is also known in the prior art to connect the sense lead 19 to the input 11 of the error amp 10 so as to provide remote control over the power supply. However, as described hereinbefore, use of the lead 16 for local control does not accommodate variations in voltage drop between the power supply inverter output section 12 and the load 19. Use of the feedback leads 19 and 20 in prior art supplies is subject to correct polarity connection, and can cause catastrophic operation in the event of an opening in either lead 19 or 20.

According to the invention, the leads 19, 20 are connected to the input nodes of a polarity correcting bridge 23. The bridge 23 has two p-channel metal-oxide-silicon field effect transistors (MOSFETs) 24, 25 and two n-channel MOSFETs 26, 27. When lead 19 is positive with respect to lead 20 (which is the normal operating situation), the upper left p-channel MOSFET 24 conducts as does the lower right n-channel MOSFET 27, thereby connecting the lead 19 to the bridge output 28 and the lead 20 to ground 18. On the other hand, if the polarity of the leads are inadvertently reversed by misconnecting at the load or at the bridge, then the lead 19 will be negative with respect to the lead 20, so the upper right n-channel MOSFET 26 will conduct as will the lower left p-channel MOSFET 25, thereby connecting the lead 20, which is positive, to the output 28 of the bridge, and connecting the lead 19, which is negative, to ground 18. Therefore, in either event, the bridge output nodes are of the same polarity; that is, the negative lead is connected to ground and the positive lead is connected to the output 28 of the bridge.

The positive output node 28 is connected to the non-inverting input (+) of a high gain comparator 29. The inverting input (–) to the comparator 29 is provided by a voltage divider 30 from any suitable, local source of reference voltage 31. Together, these provide a voltage on a line 32 which is suitable, when compared to the bridge output 28, to indicate that no voltage is being fed back. For instance, the voltage on the lead may be 20% of the nominal rated voltage or maximum voltage equivalent on the bridge output 28. So long as the bridge output 28 is more positive than the voltage divider input 32 to the comparator 29, the output 33 of the comparator is positive, causing a p-channel MOSFET 34 to remain off. In this situation, the output of the bridge 28 is fed to the input 11 of the error amp 10 through isolation resistors 35, 36. However, should either of the remote sense leads 19 or 20 become open-circuited, the bridge 23 will have no output, so the comparator output 33 will no longer be positive, and the MOSFET 34 will then connect the local output voltage on a lead 37 through the resistor 36 to the input 11 of the error amp 10. Thus, regulation in response to the local output voltage occurs, which is of course reasonably close to the load voltage, and certainly better than a clamp which would simply prevent a catastrophic overvoltage condition. In other words, the circuit fails softly in a mode which is operational, although of reduced accuracy. A diode 38 will clamp the input of the error amp 10 to the local output voltage on line 27 in the event that the FET 34 fails. If the normal (when off) voltage of the FET, which is a function of the nominal difference between the remote (19) and local (16) voltages (about 0.4 v in this embodiment) is more than the forward bias voltage of the diode (about 0.7 v, in this embodiment), then additional diodes may be connected in series with the diode 38. The resistor 39 provides the positive output of the comparator 29 across the gate/source junction of the FET 34 to ensure it stays off as long as the sense leads 19, 20 are providing voltage through the bridge 23.

If desired, the switching apparatus 29–39 may be used to monitor the remote leads and substitute local feedback when necessary, without using the polarity correcting bridge 23.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A regulated power source for applying DC power to a remote load, comprising:

a pair of remote sense leads having their distal ends connected to said load for providing an indication of the voltage across said load;

a polarity correcting bridge having its input nodes connected across the proximal ends of said remote sense leads;

a regulated DC power supply having an output connected by conductors to said load and having a feedback voltage input;

and a switching circuit responsive to the output nodes of said bridge for connecting the output node of said bridge to said feedback voltage input, and for connecting said output of said power supply to said feedback voltage input in response to the voltage across the output nodes of said bridge being less than a threshold magnitude.

2. A power source according to claim 1 wherein said switching circuit comprises a MOSFET switch.

3. A power source according to claim 1 wherein said switching circuit comprises a switch, a reference voltage source, and a comparator responsive to said source and to said output nodes for operating said switch in response to the output of said comparator indicating the voltage across said output nodes being less than the voltage of said source.

4. A regulated power source for applying DC power to a remote load, comprising:

a pair of remote sense leads having their distal ends connected to said load for providing an indication of the voltage across said load;

a regulated DC power supply having an output connected by conductors to said load and having a feedback voltage input connected for response to the voltage indication provided by said sense leads;

and a switching circuit responsive to the voltage indication provided by said sense leads for connecting said output of said power supply to said feedback voltage input in response to the voltage indication provided by said sense leads being less than a threshold magnitude.

5. A power source according to claim 4 wherein said switching circuit comprises a MOSFET switch.

6. A power source according to claim 4 wherein said switching circuit comprises a switch, a reference voltage source, and a comparator responsive to said source and to the voltage indication provided by said sense leads for operating said switch in response to the output of said comparator indicating the voltage indication provided by said sense leads being less than the voltage of said source.

* * * * *